United States Patent [19]

Smither et al.

[11] Patent Number: 4,953,191

[45] Date of Patent: Aug. 28, 1990

[54] HIGH INTENSITY X-RAY SOURCE USING LIQUID GALLIUM TARGET

[75] Inventors: Robert K. Smither, Hinsdale, Ill.; Gordon S. Knapp, Cupertino, Calif.; Edwin M. Westbrook, Chicago; George A. Forster, Westmont, both of Ill.

[73] Assignee: The United States of America as represented by the United States Department of Energy, Washington, D.C.

[21] Appl. No.: 384,193

[22] Filed: Jul. 24, 1989

[51] Int. Cl.[5] ..... H01J 35/08

[52] U.S. Cl. ..... 378/143; 378/126; 378/127; 378/130

[58] Field of Search ..... 378/47, 119, 125, 127, 378/130, 141, 143, 126

[56] References Cited

U.S. PATENT DOCUMENTS

| | | | |
|---|---|---|---|
| 3,246,146 | 4/1966 | Cohen et al. | 378/47 |
| 3,296,476 | 1/1967 | Hofmann | 378/143 |
| 3,711,736 | 1/1973 | Gabbay | 378/130 |
| 3,719,847 | 3/1973 | Webster | 378/141 |
| 3,914,633 | 10/1975 | Diemer et al. | 378/143 |
| 4,455,504 | 6/1984 | Iversen | 378/141 |
| 4,622,687 | 11/1986 | Whitaker et al. | 378/130 |
| 4,723,262 | 2/1988 | Noda et al. | 378/143 |

FOREIGN PATENT DOCUMENTS

| | | | |
|---|---|---|---|
| 0186491 | 7/1986 | European Pat. Off. | 378/119 |
| 0145257 | 9/1982 | Japan | 378/119 |

*Primary Examiner*—Janice A. Howell
*Assistant Examiner*—John C. Freeman
*Attorney, Agent, or Firm*—Helen S. Cordell; John M. Albrecht; William R. Moser

[57] ABSTRACT

A high intensity x-ray source that uses a flowing stream of liquid gallium as a target with the electron beam impinging directly on the liquid metal.

9 Claims, 3 Drawing Sheets

HIGH INTENSITY X-RAY SOURCE USING LIQUID GALLIUM TARGET

CONTRACTUAL ORIGIN OF THE INVENTION

The U.S. Government has rights in this invention pursuant to Contract No. W-31-109-ENG-38 between the U.S. Department of Energy and the University of Chicago.

BACKGROUND OF THE INVENTION

This invention relates to a device which produces high intensity x-rays by bombarding a flowing stream of liquid gallium with an electron beam, thereby avoiding the cooling and contamination problems associated with prior art x-ray sources while permitting the use of large electron beam power.

The need for continuous duty, high intensity x-ray tubes exists in medical radiography, i.e., fluoroscopy and computerized tomography (CT), and in industrial applications such as x-ray diffraction and non-destructive testing. In the prior art the efficiency and lifetime of these instruments has been limited by two major factors: the tendency of large power densities of bombarding electron beams to heat the target surface, roughing and even melting the anode at the focal spot, and the buildup on the anode of contaminating materials.

Some prior art devices avoid the problems of heating by rapidly rotating the anode to bring cooler metal surfaces into the focal spot area, or by coating the anode with, e.g. ceramic oxides, to increase the thermal emission of the target. Liquid cooled rotating anode x-ray tubes are common. A hollow anode is rotated, and the heat generated by irradiation by the electron beam is transmitted to a heat exchange surface, typically the interior wall of the hollow anode. Generally the interior wall is roughed to increase turbulence, and a flow of liquid coolant, usually water, is passed into contact with the wall to remove the heat and cool the anode.

One invention (U.S. Pat. No. 3,719,847 issued to Webster, Mar. 6, 1973) uses a liquid metal with a relatively low boiling point as a coolant within the rotating anode. The heat created by the energy beam striking the target wall is sufficient to vaporize the liquid metal in contact with the inner surface of the wall at the point where the beam strikes the wall, and heat is drawn away from the wall by vaporization. As the anode is rotated, the vaporized metal is returned by centrifugal force into contact with and condenses on other portions of the inner surface of the wall, where it is again available to draw off heat through vaporization.

Maintenance problems associated with prior art x-ray sources sometimes cause as much as 50% downtime. Because most rotary anode x-ray sources require high speed anode rotation and high coolant pressures, an appreciable portion of the downtime for rotary anode x-ray sources is related to mechanical wear on rotating bearings and seals, and the need to reestablish a vacuum after vacuum enclosed parts are repaired.

The utility of prior art high intensity x-ray sources is limited as well by the tendency for contaminating materials to accumulate on the anode. Water bearing surfaces are subject to buildup due to corrossion. In addition, both rotary and stationary anodes become contaminated by the buildup of filament material transferred to the anode from the cathode. For example, if the cathode is made of tungsten, tungsten characteristic lines will appear in the output x-ray spectrum, which may not be desirable for the particular purpose of the instrument.

In most cases the response of the prior art has been simply to require that the instrument be shut down and cleaned. Alternative cleaning methods introduce apparatus for continuous cleaning using sputtering of the anode surface, thereby increasing the size and complexity of the x-ray device and making it more breakdown prone.

It is therefore a primary object of this invention to provide an apparatus which avoids the cooling and cleaning problems typically associated with prior art high intensity x-ray sources.

In the accomplishment of the foregoing object, it is another important object of this invention to provide an apparatus which permits the use of larger electron beam power and therefore increases the maximum intensity of x-rays obtainable when compared to standard rotary anode sources.

It is another important object of this invention to provide an apparatus which is characterized by high stability, long lifetime and low maintenance.

Additional objects, advantages and novel features of the invention will become apparent to those skilled in the art upon examination of the following and by practice of the invention.

SUMMARY OF THE INVENTION

To achieve the foregoing and other objects, this invention comprises a high intensity x-ray source that uses a flowing stream of liquid gallium as a target with the electron beam impinging directly on the liquid metal. The heat generated on the target surface is carried away by the flowing stream of liquid gallium, so that the target and the cooling fluid are one and the same.

BRIEF DESCRIPTION OF THE DRAWINGS

The present invention is illustrated in the accompanying drawings where.

FIG. **2*a* depicts major components of an electromagnetic induction pump

DETAILED DESCRIPTION OF THE INVENTION

Figure 1:
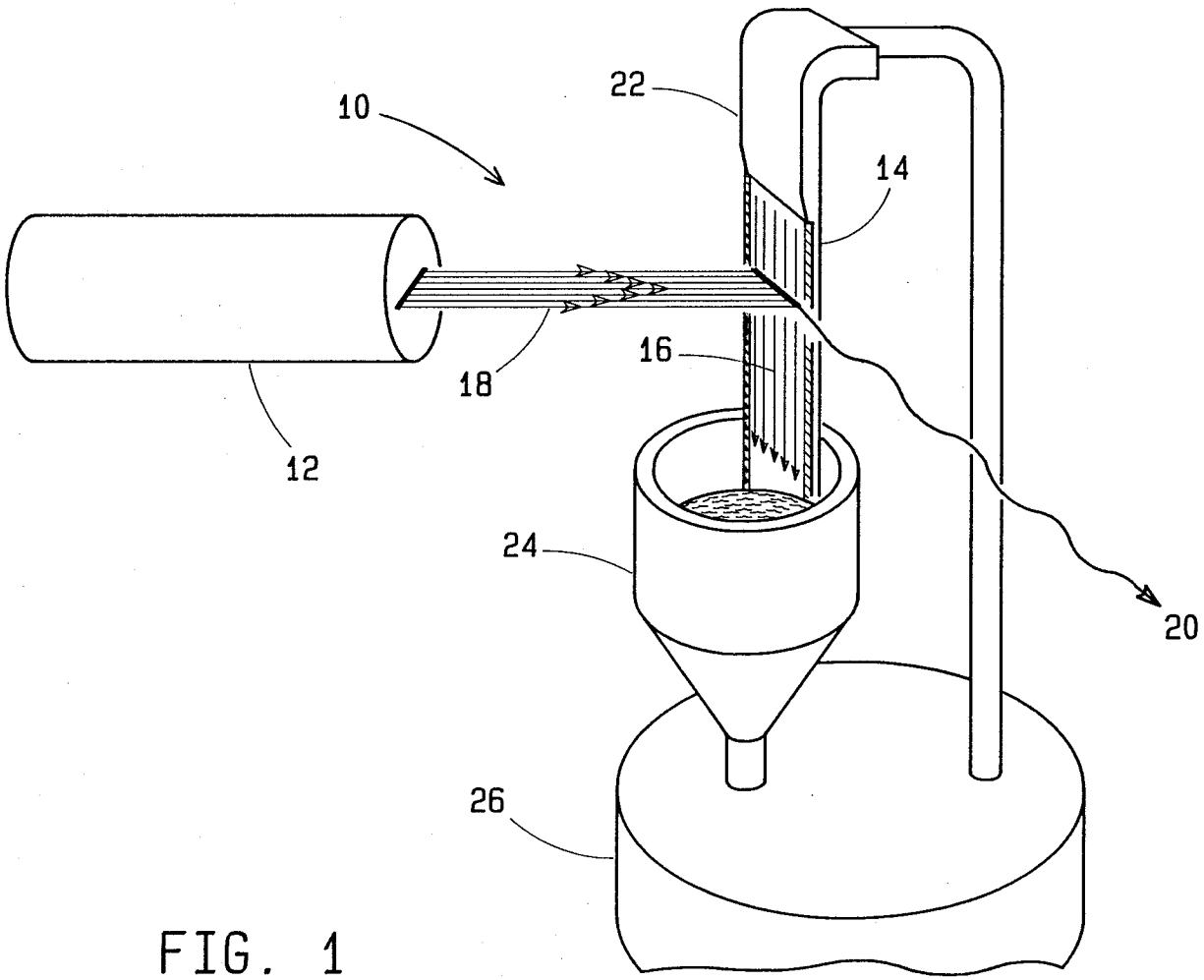
FIG. 1 is a schematic of one embodiment of the invention, wherein electrons are emitted from a heated tungsten filament and accelerated by a high voltage to a stream of liquid gallium, producing high frequency x-rays in a small point source.

State of the art liquid cooled rotating anode x-ray tubes generally have heat transfer capabilities in the 600 to 1200 watts/cm$^2$ range; achievement of heat transfer rates of 12,000 watts/cm$^2$ using prior art designs requires using high liquid flow rates and pressures in the proximity of the heat exchange surface. (See, for example, U.S. Pat. No. 4,622,687 issued to Whittaker, Nov. 11, 1986).

The present invention circumvents these requirements by using a stream of liquid gallium as the anode in an x-ray source. The liquid gallium metal serves as both the target for the electrons and as the cooling fluid, in that the heat generated by the electron beam is carried away by the flowing stream of liquid gallium.

Liquid gallium metal is used as a heat transfer fluid because it has both a high thermal conductivity and a high volume specific heat. Its low kinetic viscosity also facilitates its ability to remove heat, and enhances its ability to maintain a surface which is flat. Another special property of liquid gallium is its very low vapor pressure at elevated temperatures, $10^{-12}$ Torr at 100° C., $10^{-11}$ Torr at 300° C., etc. This means that gallium exposed to the vacuum will not generate large volumes of gas and destroy the vacuum as would be the case with cooling fluids such as water or mercury. The reverse will happen. The liquid gallium will slowly combine with the residual oxygen present and thereby pump on the system, improving the vacuum.

The melting point of gallium is 29.8° C. This is just above room typical temperature and means that if any gallium does leak out into the vacuum chamber it will freeze and remain where it falls, with a vapor pressure even lower than that of the liquid. The 29.8° C. melting point is low enough that the gallium can be kept in the liquid state at temperatures close to room temperature. This is important in that it simplifies the thermal insulation problem for the cooling system and keeps the possible thermal stresses in the associated apparatus at a minimum.

Following is a table comparing the fluid properties of gallium and water. The "figure of merit" given in the last row is the product of the thermal conductivity and the specific heat per unit volume and is a good measure of the efficiency of the cooling fluid at low fluid velocities. Judged in this way, liquid gallium is 30 times as efficient as water.

TABLE 1

| | Ga | $H_2O$ |
|---|---|---|
| Density(g/cm$^3$ | 6.1 | 1.0 |
| Melting point (°C.) | 29.8 | 0.0 |
| Boiling point (°C.) | 2205.0 | 100.0 |
| Thermal conductivity (W/cm °C.)) | 0.41 | 0.0068 |
| Volume heat capacity (J/(cm$^3$ °C.)) | 2.2 | 4.2 |
| Viscosityy (cP) | 1.61 | 1.0 |
| Kinetic Viscosity (cP/(g cm$^3$)) | 0.27 | 1.0 |
| Figure of merit | 0.90 | 0.029 |

When water is used as a cooling agent with a rotating anode, the maximum x-ray intensity attainable is limited by the heat transfer coefficient of the water flowing through the cooling channels and the amount of water than can be pushed through the system. It is common to attempt to increase x-ray intensity in a water cooled rotary anode x-ray source by increasing the coolant velocity and pump pressures. Unfortunately, the seals necessary to join stationary to rotating fluid conduits generally have short lives when subjected to high coolant pressures and high speed anode rotation. In contrast, the maximum allowable surface temperature for liquid gallium is determined by the allowable vapor pressure for the gallium. The vapor pressure of gallium is very low at temperatures below 500° C. At 100°, 200°, and 400° C. it is $10^{-12}$, $10^{-11}$, and $10^{-9}$ Torr., respectively. Even at 400° C. the vapor pressure is well below what is in the x-ray chamber. The very good heat conductivity of the gallium dissipates the heat in the gallium stream very quickly so that only the gallium quite close to the electron beam spot is very hot.

FIG. 1 is a schematic of one embodiment of the invention, wherein electrons are emitted from a heated tungsten filament and accelerated by a high voltage to impinge on a flowing stream of liquid gallium, producing high frequency x-rays in a small point source.

Referring to FIG. 1, the x-ray source indicated generally by the arrow 10 comprises an electron gun 12 and an anode 14. A continuous flow of liquid gallium 16 is established by a distribution head 22, a sump 24 and a gallium pump 26.

The electron gun 12, which contains a hot tungsten filament (not shown) at a large negative voltage preferably on the order of −50,000 volts provides a stream of electrons designated by lines 18 which are attracted to the anode 14 which is at ground potential. The anode 14 is comprised of a stainless steel plate of machineable high-chrome stainless steel over which flows a stream of liquid gallium 16. The anode 14 is nearly perpendicular to the longitudinal axis of the electron gun 12.

In response to bombardment by electrons, the anode 14 emits x-rays which propagate an angle of about 5 degrees with the longitudinal axis of the electron gun 12, providing a point source for the apparatus making use of the x-ray source 10 in the direction indicated by arrow 20.

Those skilled in the art will recognize that if a line source is desired then the electron beam may be broadened and rotated 90° so that when viewed at a small angle relative to the surface of the anode 14 then it appears as an intense line source.

Liquid gallium 16 flows from a distribution head 22 in a nearly flat stream, is collected by a sump 24, and returned to the distribution head 22 by the gallium pump 26. In the preferred embodiment the liquid gallium 16 flows at a velocity measured at the distribution head 22 of 200 cm per sec. With the distribution head 22 having a cross-section of 0.2 cm$^2$, the liquid gallium 16 flows at a rate of 40 cc per sec. If the temperature of the liquid gallium rises 100° C. during operation, the system attains a heat transfer of $2.2\times40\times100=8.8$ KW.

Thus, the average temperature rise in the gallium stream is not a limiting factor in the level of heat transfer even at these high powers. The limiting factor is the maximum allowable temperature in the hot spot under the beam, which is dependent upon the beam spot size and the rate of liquid gallium flow. To achieve a wide beam spot size or beam width the gallium surface should be smooth, non-fluctuating either in position or time, and moving rapidly. These tend to be conflicting requirements because smooth surfaces require laminar flow while high velocity means a high Reynolds number and turbulent flow. However, a plus factor is the high surface tension of gallium.

In addition, since liquid gallium is a liquid metal it can be pumped with an electromagnetic induction pump in a manner similar to the way liquid sodium is pumped through a high temperature reactor, giving a steady pressure to the fluid and avoiding any of the pulsations associated with normal rotary blade or piston type pumps.

Figures 2A, 2B, 2C, 2D:
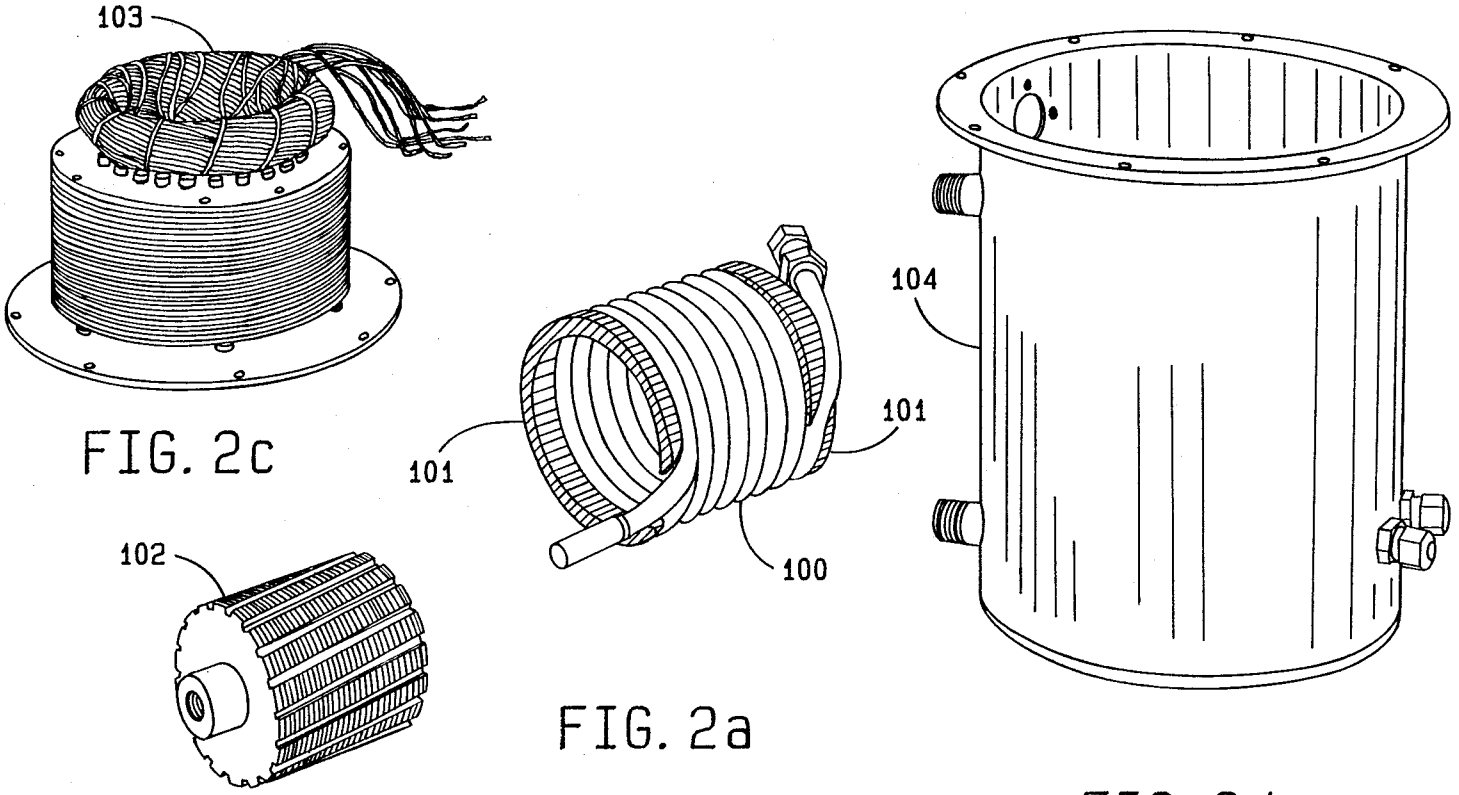
FIG. 2*b*** is a schematic showing the pump in a system wherein liquid gallium is used as the anode of an x-ray source.
Figure 2E:
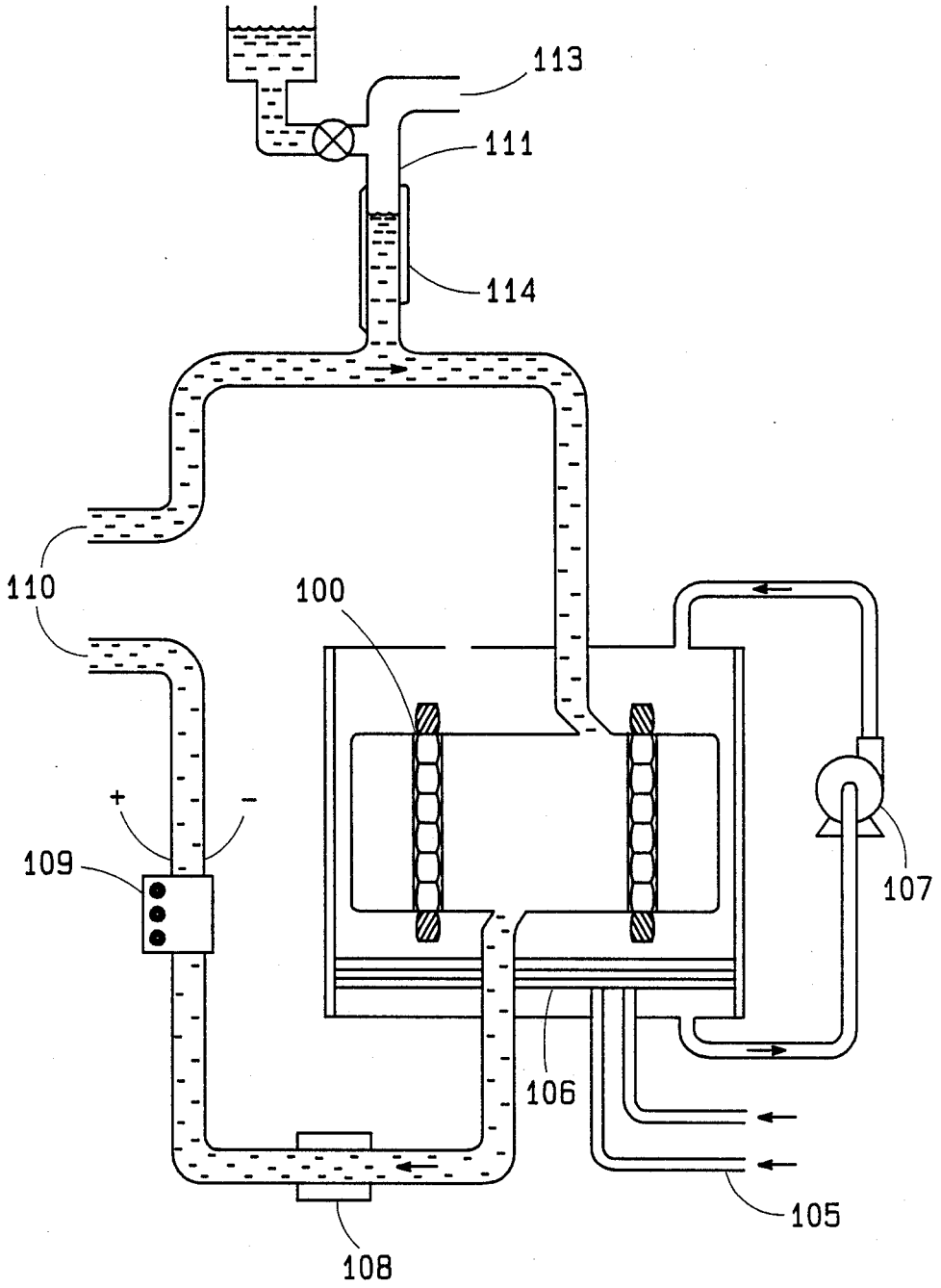

The electromagnetic induction pump or gallium pump 26 in FIG. 1 is constructed using components of a typical 5 hp., 3 phase induction motor. FIG. 2*a* shows major components before assembly. A stainless steel tube with three-eighths inch o.d. is formed into a spiral coil 100 through which will pass the liquid gallium. With eight or nine turns, the coil 100 is 3.5 inches high. The turns of the coil 100 are soldered together for improved electrical contact and a copper end ring 101 is soldered into each end of the coil 100. Each end ring 101 is an electrically conductive bus bar whose function is to conduct the induced currents in the the coil 100 from one pole to the next so that the currents remain axial over the total length of the coil 100. Without the end rings 101 the current in the turns at the ends of the spiral would travel along the turns rather than across them and thus add no pressure to the fluid.

The rotor 102 of the induction motor is machined down to make room for the coil 100 between the rotor 102 and the motor windings and induction magnet assembly 103. A stainless steel housing 104 is provided.

During operation the rotor 102 remains stationary, and the rotating radial magnetic field in the motor induces a current in the gallium in the coil 100 that flows from one end of the coil 100 to the other, passing through each turn of the coil 100 transverse to the flow direction. This current interacts with the magnetic field and applies a force on the gallium that induces flow in the coil 100.

FIG. 2*b* is a schematic of the pump in a portable system which is capable of controlling the output temperature of liquid gallium and can handle heat loads of 10 kw. To begin operation, liquid gallium must "wet" the inside of the spiral coil 100, or make good electrical contact with the coil 100 so that induced currents may flow axially along the coil 100. Gallium will wet 304 stainless steel at temperatures of about 750° F. Once wet the 304 SST will remain wet at lower temperatures. The liquid gallium pump is cooled using an oil pump 107 which circulates oil through channels in the motor assembly and heat is removed from the oil by a heat exchanger 106, cooled by a flow of water 105. A second heat exchanger 108 controls the temperature of the liquid gallium, while an electromagnetic flow meter 109 monitors the rate of flow of the liquid gallium to the anode assembly (not shown) at 110.

A stand pipe 111 maintains the integrity of the liquid gallium flow by accommodating the expansion and contraction of the gallium during temperature changes and maintains a significant pressure head at the inlet to the pump to avoid cavitation. A level indicator 114 triggers the filling of gallium, capped by the vacuum 113 or gas in which the pump operates.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical applications and should enable others skilled in the art to utilize the invention in various embodiments and with various modifications as are suited to the particular use contemplated. It is intended that the scope of the invention be defined by the claims appended hereto.

The embodiments of this invention in which an exclusive property or privilege is claimed are defined as follows:

1. An apparatus for the generation of high intensity x-rays comprising:

means for providing a smooth, non fluctuating flow of liquid metal over a surface, and, means for directing an electron beam to impinge on said liquid metal as it flows over said surface to generate high intensity x-rays.

2. The apparatus of claim 1 including means for collecting and recycling said liquid metal to provide an uninterrupted flow over said surface.

3. The apparatus of claim 1 wherein said liquid metal is liquid gallium.

4. The apparatus of claim wherein said surface is a stainless steel plate.

5. The apparatus of claim 2 wherein said recycling means includes an electromagnetic pump.

6. In a device for the generation of high-intensity x-ray beams using an electron beam directed at an anode, an improved anode including a flow of liquid metal over a surface at ground potential, wherein said flow of liquid metal includes a substantially flat stream adjacent to and supported by said surface, and said stream adjacent to and supported by said surface emits x-rays in response to bombardment by electrons.

7. The anode of claim 6 wherein said flow of liquid metal is uninterrupted.

8. The anode of claim 7 wherein said liquid metal is liquid gallium.

9. The anode of claim 8 wherein said surface is a stainless steel plate.

* * * * *